US012392590B1

(12) United States Patent
Brush et al.

(10) Patent No.: US 12,392,590 B1
(45) Date of Patent: Aug. 19, 2025

(54) STABILIZATION AND/OR DEPLOYMENT SYSTEM

(71) Applicant: Point One USA, LLC, Virginia Beach, VA (US)

(72) Inventors: Robert E. Brush, Virginia Beach, VA (US); Cameron M. Hovenga, Virginia Beach, VA (US); Nathan J. Unger, Chesapeake, VA (US); Mike Clayton, Sparta, GA (US)

(73) Assignee: Point One USA, LLC, Virginia Beach, VA (US)

( * ) Notice: Subject to any disclaimer, the term of this patent is extended or adjusted under 35 U.S.C. 154(b) by 20 days.

(21) Appl. No.: 18/418,308

(22) Filed: Jan. 21, 2024

(51) Int. Cl.
*F42B 33/06* (2006.01)
*F42B 39/24* (2006.01)

(52) U.S. Cl.
CPC ..... *F42B 33/06* (2013.01); *F42B 39/24* (2013.01)

(58) Field of Classification Search
USPC ..... 108/55.5, 57.13, 57.21–57.24; 206/3, 206/203, 427, 486–490, 587, 589; 248/346.5
See application file for complete search history.

(56) References Cited

U.S. PATENT DOCUMENTS 4,538,723 A * 9/1985 Johnson ..... F42B 39/26 206/3
4,666,035 A * 5/1987 Johnson ..... F42B 39/26 206/3
6,290,087 B1 * 9/2001 Shacklee ..... F42B 39/00 220/582

* cited by examiner

*Primary Examiner* — Bryon P Gehman
(74) *Attorney, Agent, or Firm* — Shaddock Law Group, PC

(57) ABSTRACT

A stabilization and deployment system including at least some of a stabilization plate having a stabilization plate top side, wherein a ridge is formed in or extends from at least a portion of the stabilization plate top side, wherein, the ridge provides a perimeter around at least a portion of the stabilization plate top side to define a stabilization plate recess of the stabilization plate top side, wherein the stabilization plate recess comprises three aligned, at least partially overlapping circular recesses, wherein the circular recesses are arranged such that each circular recess at least partially overlaps each adjacent circular recess, and wherein the circular recesses are arranged so that relative centers of each of the circular recesses are spaced from one another at a distance that is equal to one and one half times a length of a radius of at least one of the circular recesses.

20 Claims, 11 Drawing Sheets

STABILIZATION AND/OR DEPLOYMENT SYSTEM

CROSS-REFERENCE TO RELATED APPLICATIONS

None.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of stabilization and deployment platforms. More specifically, the present disclosure relates to a stabilization and/or deployment system to be utilized, for example, with one or more explosive disruptor containers.

2. Description of Related Art

In the realm of improvised explosive devices and terrorist type scenarios military Explosive Ordnance Disposal ("EOD") and Public Safety Bomb Technician ("PSBT") specialists remotely access and disarm or neutralize hazardous devices with water tools, shot gun style disruptors, and robots when available.

Water systems using a high explosive to propel the water typically employ a high explosive to generate a shock wave through a liquid to provide pressure to do disruptive work. A bowl charge uses high explosives to drive water contained in the plastic bowl to disrupt an Improvised Explosive Device ("IED"). The shock pressures drive the water to do work but, depending on the bowl charge construction and design, the performance of the tool can vary and be inconsistent.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, typical explosive disruptor containers have various shortcomings. For example, it can be difficult to maintain proper alignment of one or more explosive disruptor containers during transport, by either human, robotic, or other means. Additionally, it can be difficult to maintain appropriate placement of explosive disruptor containers once they have been deployed and are awaiting use or detonation.

The present disclosure provides a stabilization and/or deployment system that overcomes the shortcomings of known explosive disruptor containers and provides a stabilization and/or deployment system that can be used to maintain alignment of one or more explosive disruptor containers during transportation and placement and maintain appropriate placement of the one or more explosive disruptor containers once they have been deployed.

In certain exemplary, non-limiting embodiments, the stabilization assembly includes a stabilization plate and connector rings. In certain exemplary embodiments, the stabilization assembly optionally includes stabilization rods and a strap system.

The stabilization plate is a platform designed to hold one or more bottles or containers in place and provides a stable base to reduce the chance of the container(s) tipping over when being deployed. There are raised outlines or ridges on the stabilization plate to hold the container(s) in place. Stabilization rods can optionally be inserted into the stabilization plate to enhance the stabilization of the stabilization plate, dependent on the terrain features where the stabilization assembly is to be deployed.

A connector ring goes around the neck of each container. Multiple containers can be attached together side by side using the connector rings and corresponding, mating connector ring projections and connector ring recesses of adjacent connector rings.

The strap system includes one or more straps that are attached to both the stabilization plate and connector ring. The straps are tightened to further secure the container(s) firmly between the stabilization plate and connector ring. Additional straps may optionally be attached to the connector rings to provide a carry handle for the stabilization assembly for remote or manual placement.

In various exemplary, non-limiting embodiments, the stabilization and/or deployment system of the present disclosure comprises at least some of a stabilization plate having a stabilization plate top side, wherein a ridge is formed in or extends from at least a portion of the stabilization plate top side, wherein, the ridge provides a perimeter around at least a portion of the stabilization plate top side to define a stabilization plate recess of the stabilization plate top side, wherein the stabilization plate recess comprises three aligned, at least partially overlapping circular recesses, wherein the circular recesses are arranged such that each circular recess at least partially overlaps each adjacent circular recess, and wherein at least one connector stabilization plate anchor slot is formed through the stabilization plate, wherein the at least one stabilization plate anchor slot is formed so as to allow an anchor strap to be attached thereto or positioned therethrough; a plurality of rod boreholes formed to extend into portions of the stabilization plate, wherein each rod borehole allows at least a portion of an elongate stabilization rod to be positioned therein such that the stabilization rod extends from the stabilization plate; at least one connector ring, wherein each the at least one connector ring comprises a ring body having a ring aperture formed through the ring body, wherein the ring aperture is formed so as to allow at least a portion of a container to extend therethrough such that the connector ring may be positioned atop a portion of a container such that at least a portion of the container extends beyond the ring aperture to allow a container cap to be attached or coupled to the container and secure the connector ring to the container, via the container cap, and wherein at least one connector ring anchor slot is formed through the connector ring body, wherein the at least one connector ring anchor slot is formed so as to allow an anchor strap to be attached thereto or positioned therethrough; and at least one anchor strap, wherein a portion of the at least one anchor strap may be positioned through the at least one stabilization plate anchor slot and a portion of the at least one anchor strap may be positioned through the at least one connector ring anchor slot to attach or couple the at least one connector ring to the stabilization plate.

In various exemplary, nonlimiting embodiments, the stabilization plate comprises a rectangular portion of material.

In various exemplary, nonlimiting embodiments, the container comprises a plastic bottle.

In various exemplary, nonlimiting embodiments, the container is a container of an explosive disruptor.

In various exemplary, nonlimiting embodiments, the stabilization plate comprises a rectangular portion of material.

In various exemplary, nonlimiting embodiments, at least a portion of the stabilization plate top side is substantially planar.

In various exemplary, nonlimiting embodiments, a surface of the stabilization plate, defined within the stabilization plate recess, is substantially planar.

In various exemplary, nonlimiting embodiments, the ridge comprises a continuous, uninterrupted ridge.

In various exemplary, nonlimiting embodiments, the ridge comprises two or more ridge segments, which together generally define the stabilization plate recess.

In various exemplary, nonlimiting embodiments, the circular recesses are arranged so that relative centers of each of the circular recesses are aligned along a longitudinal axis of the stabilization plate.

In various exemplary, nonlimiting embodiments, the circular recesses are arranged so that relative centers of each of the circular recesses are equally spaced from one another.

In various exemplary, nonlimiting embodiments, the circular recesses are arranged so that relative centers of each of the circular recesses are spaced from one another at a distance that is equal to one and one half times a length of a radius of at least one of the circular recesses.

In various exemplary, nonlimiting embodiments, at least an interior portion of the ridge, which extends from a surface of the stabilization plate recess toward an uppermost apex or top of the ridge is sloped or arced.

In various exemplary, nonlimiting embodiments, the container is positionable atop the stabilization plate top side, within a portion of the stabilization plate recess, such that at least a portion of an interior portion of the ridge contacts at least a portion of an exterior portion of the container, within at least a portion of one of the circular recesses so as to resist lateral movement of the container relation to the stabilization plate.

In various exemplary, nonlimiting embodiments, at least some of the plurality of rod boreholes are formed substantially parallel to the longitudinal axis of the stabilization plate and wherein at least some of the plurality of the rod boreholes are formed substantially perpendicular to the longitudinal axis of the stabilization plate.

In various exemplary, nonlimiting embodiments, at least some of the plurality of rod boreholes are formed at acute or obtuse angles relative to the longitudinal axis of the stabilization plate.

In various exemplary, nonlimiting embodiments, each the connector ring includes a connector ring recess and a connector ring projection, wherein the connector ring recess is formed so as to matingly correspond to the connector ring projection such that adjacent connector rings can be maintained in a desired position, relative to one another, via slidable attachment of corresponding, mating connector ring projections and connector ring recesses of adjacent connector rings.

In various exemplary, nonlimiting embodiments, the connector ring recess is formed in the connector ring at a position opposite a position of the connector ring projection.

In various exemplary, non-limiting embodiments, the stabilization and/or deployment system of the present disclosure comprises at least some of a stabilization plate having a stabilization plate top side, wherein a ridge is formed in or extends from at least a portion of the stabilization plate top side, wherein, the ridge provides a perimeter around at least a portion of the stabilization plate top side to define a stabilization plate recess of the stabilization plate top side, wherein the stabilization plate recess comprises three aligned, at least partially overlapping circular recesses, wherein the circular recesses are arranged such that each circular recess at least partially overlaps each adjacent circular recess, and wherein a container is positionable atop the stabilization plate top side, within a portion of the stabilization plate recess, such that at least a portion of an interior portion of the ridge contacts at least a portion of an exterior portion of the container, within at least a portion of one of the circular recesses so as to resist lateral movement of the container relation to the stabilization plate; and a plurality of rod boreholes formed to extend into portions of the stabilization plate, wherein each rod borehole allows at least a portion of an elongate stabilization rod to be positioned therein such that the stabilization rod extends from the stabilization plate.

In various exemplary, non-limiting embodiments, the stabilization and/or deployment system of the present disclosure comprises at least some of a stabilization plate having a stabilization plate top side, wherein a ridge is formed in or extends from at least a portion of the stabilization plate top side, wherein, the ridge provides a perimeter around at least a portion of the stabilization plate top side to define a stabilization plate recess of the stabilization plate top side, wherein the stabilization plate recess comprises three aligned, at least partially overlapping circular recesses, wherein the circular recesses are arranged such that each circular recess at least partially overlaps each adjacent circular recess, and wherein the circular recesses are arranged so that relative centers of each of the circular recesses are spaced from one another at a distance that is equal to one and one half times a length of a radius of at least one of the circular recesses; and a plurality of rod boreholes formed to extend into portions of the stabilization plate, wherein each rod borehole allows at least a portion of an elongate stabilization rod to be positioned therein such that the stabilization rod extends from the stabilization plate, wherein at least some of the plurality of rod boreholes are formed substantially parallel to the longitudinal axis of the stabilization plate and wherein at least some of the plurality of the rod boreholes are formed substantially perpendicular to the longitudinal axis of the stabilization plate.

Accordingly, the present disclosure provides a stabilization and/or deployment system that provides a stabilization and/or deployment system that can be used to maintain alignment of one or more explosive disruptor containers during transportation and placement.

The present disclosure separately and optionally provides a stabilization and/or deployment system that maintains placement of the one or more explosive disruptor containers once they have been deployed.

The present disclosure separately and optionally provides a stabilization and/or deployment system that can utilize one or more stabilization rods to provide additional stability to a stabilization plate.

The present disclosure separately and optionally provides a stabilization and/or deployment system that can be used with one or more explosive disruptor containers.

The present disclosure separately and optionally provides a stabilization and/or deployment system that can support multiple explosive disruptor containers in a desired alignment.

The present disclosure separately and optionally provides a stabilization and/or deployment system that can be easily utilized by a user.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures.

While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF EXEMPLARY EMBODIMENTS OF THE PRESENT DISCLOSURE

Figure 1:
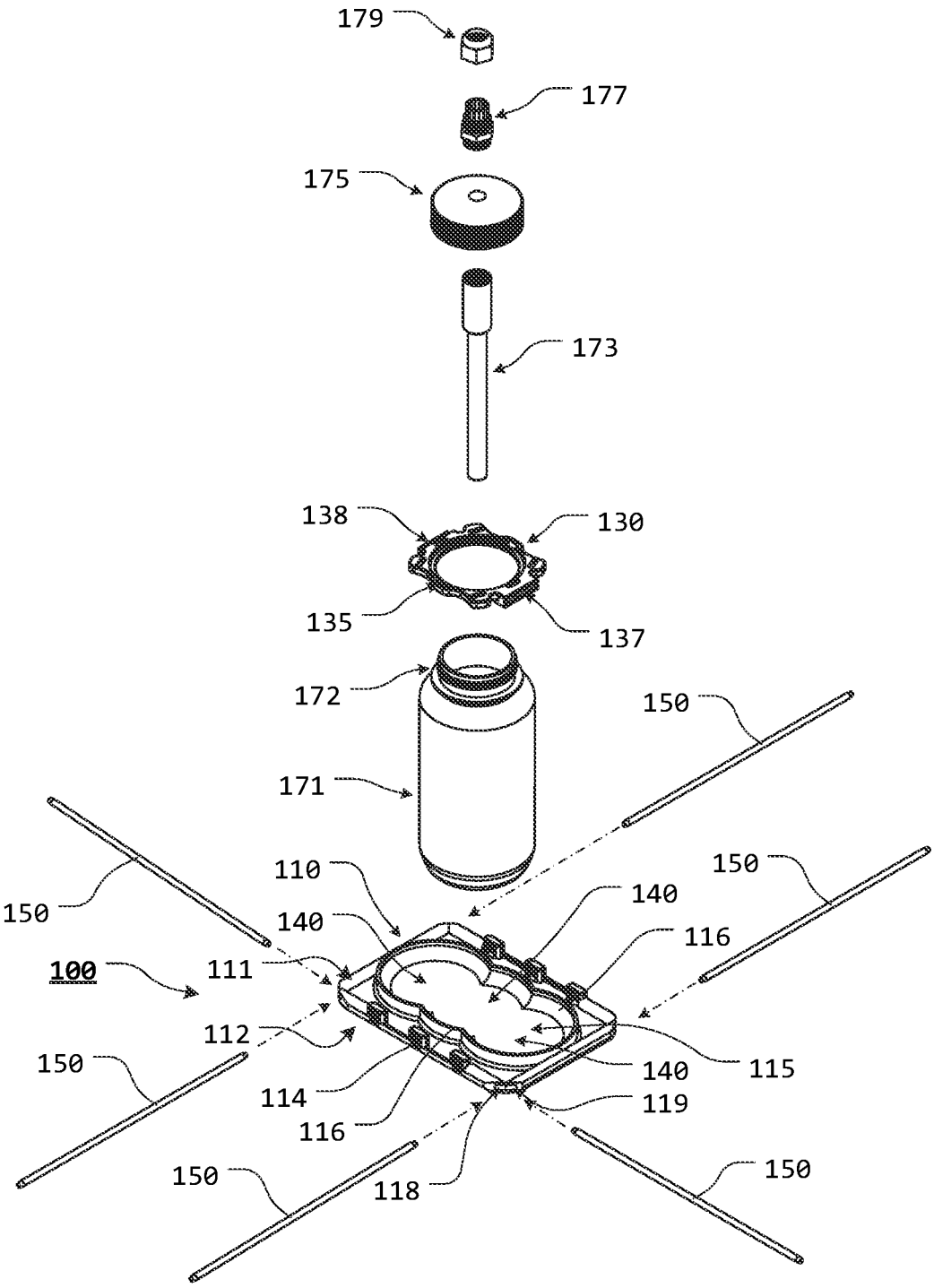
FIG. 1 illustrates an upper, perspective, exploded view of certain exemplary components of an exemplary embodiment of the stabilization and/or deployment system, according to at least one exemplary, non-limiting embodiment of the present disclosure.

For simplicity and clarification, the design factors and operating principles of the stabilization and/or deployment system according to the present disclosure are explained with reference to various exemplary embodiments of a stabilization and/or deployment system according to the present disclosure. The basic explanation of the design factors and operating principles of the rack system is applicable for the understanding, design, and operation of the rack system of the present disclosure. It should be appreciated that the stabilization and/or deployment system can be adapted to many applications where a stabilization and/or deployment system can be used.

As used herein, the word "may" is meant to convey a permissive sense (i.e., meaning "having the potential to"), rather than a mandatory sense (i.e., meaning "must"). Unless stated otherwise, terms such as "first" and "second", "right" and "left", "top" and "bottom", "upper" and "lower", and "horizontal" and "vertical" are used to arbitrarily distinguish between the exemplary embodiments and/or elements such terms describe. Thus, these terms are not necessarily intended to indicate temporal or other prioritization of such exemplary embodiments and/or elements.

As used herein, and unless the context dictates otherwise, the term "coupled" is intended to include both direct coupling (in which two elements that are coupled to each other contact each other) and indirect coupling (in which at least one additional element is located between the two elements). The term coupled, as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that, for simplicity and clarification, certain embodiments of the present disclosure may be described using terms such as "front", "back", "rear", "right", "left", "upper", "lower", "outer", and/or "inner". However, it should be understood that these terms are merely used to aid in understanding the present disclosure are not to be construed as limiting the systems, methods, devices, and/or apparatuses of the present disclosure. Additionally, it should be appreciated that, unless otherwise stated, the design factors and operating principles of the presently disclosed stabilization and/or deployment system may optionally be used in a "mirror image" assembly, wherein elements shown and/or described as being included in or on a drive end portion may optionally be included in or on a non-drive end portion. Alternatively, certain of the elements that are shown and/or described as being included in or on a back portion may optionally be included in or on a front portion, or vice versa.

It should also be appreciated that the terms "stabilization and/or deployment system", "stabilization plate", "stabilization rod", "connector ring", and "explosive disruptor" are used for basic explanation and understanding of the operation of the systems, methods, and apparatuses of the present disclosure. Therefore, the terms "stabilization and/or deployment system", "stabilization plate", "stabilization rod", "connector ring", and "explosive disruptor" are not to be construed as limiting the systems, methods, and apparatuses of the present disclosure.

For simplicity and clarification, the stabilization and/or deployment system of the present disclosure will be described as being used in conjunction with an exemplary embodiment of an explosive disruptor container. However, it should be appreciated that these are merely exemplary embodiments of the stabilization and/or deployment system and are not to be construed as essential to or limiting the present disclosure. Thus, the stabilization and/or deployment system of the present disclosure may be utilized in conjunction with any embodiment of an explosive disruptor container and can be used with one or more explosive disruptor containers.

Turning now to the drawing FIGS., FIGS. 1-21 illustrate certain elements and/or aspects of an exemplary embodiment of the stabilization and/or deployment system, according to at least one exemplary, non-limiting embodiment of the present disclosure. In illustrative, non-limiting embodiment(s) of the present disclosure, as illustrated in FIGS. 1-21, the stabilization assembly 100 comprises a stabilization plate 110 and optionally one or more stabilization rods 150, one or more connector rings 130, and one or more anchor straps 180.

The stabilization plate 110 is a platform designed to hold one or more bottles or containers 171 in place and provides a stable base or platform to reduce the chance of the one or more bottles or containers 171 tipping over when being deployed.

Figure 2:
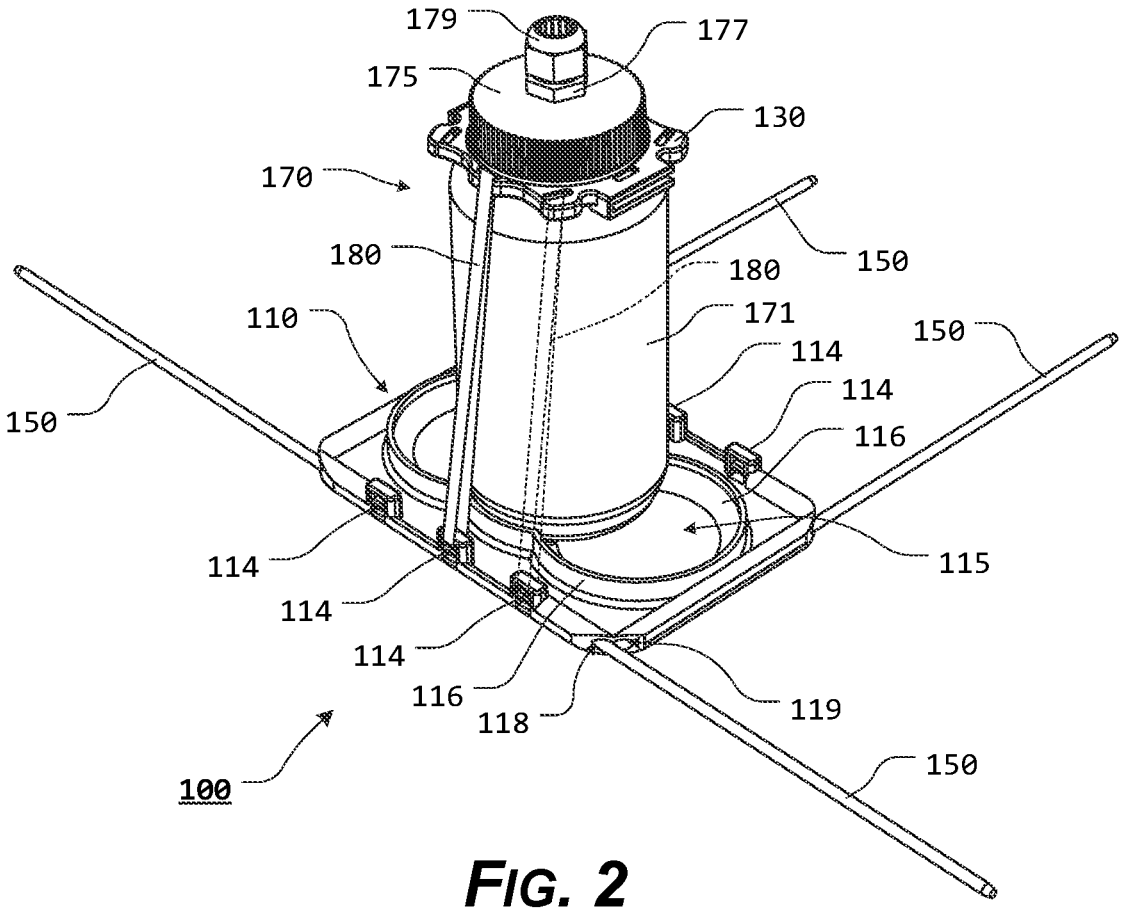
FIG. 2 illustrates an upper, perspective view of certain exemplary components of an exemplary embodiment of the stabilization and/or deployment system, according to at least one exemplary, non-limiting embodiment of the present disclosure.
Figure 3:
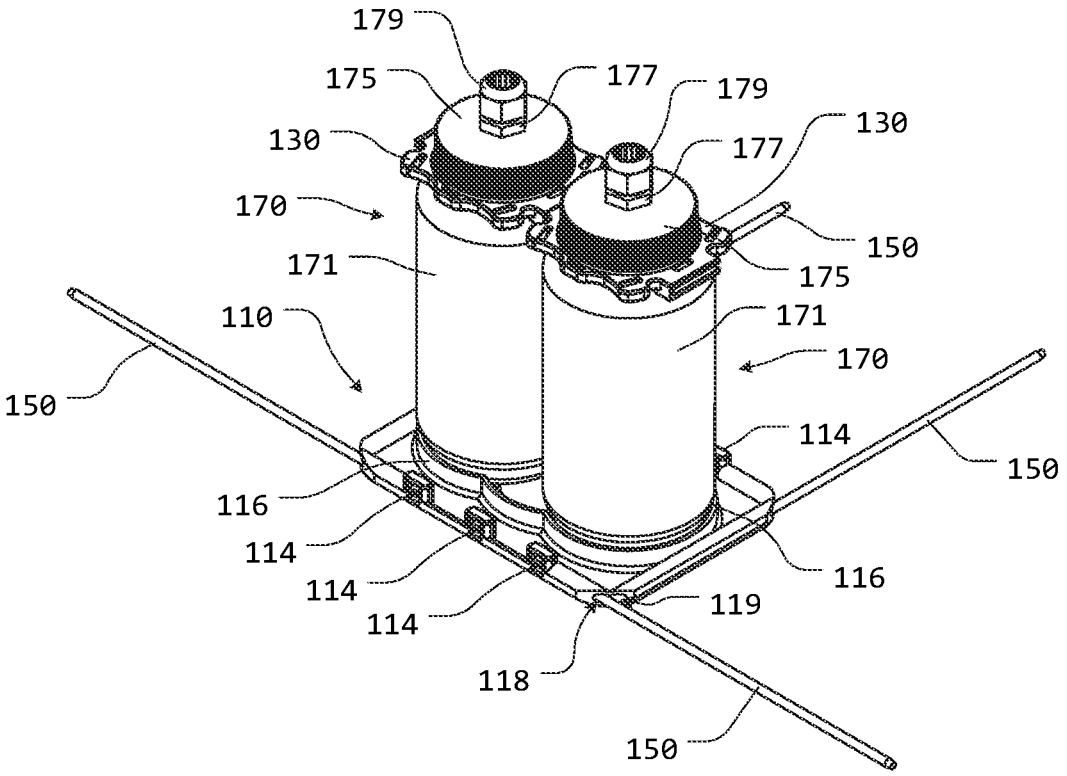
FIG. 3 illustrates an upper, perspective view of certain exemplary components of an exemplary embodiment of the stabilization and/or deployment system, according to at least one exemplary, non-limiting embodiment of the present disclosure.
Figure 4:
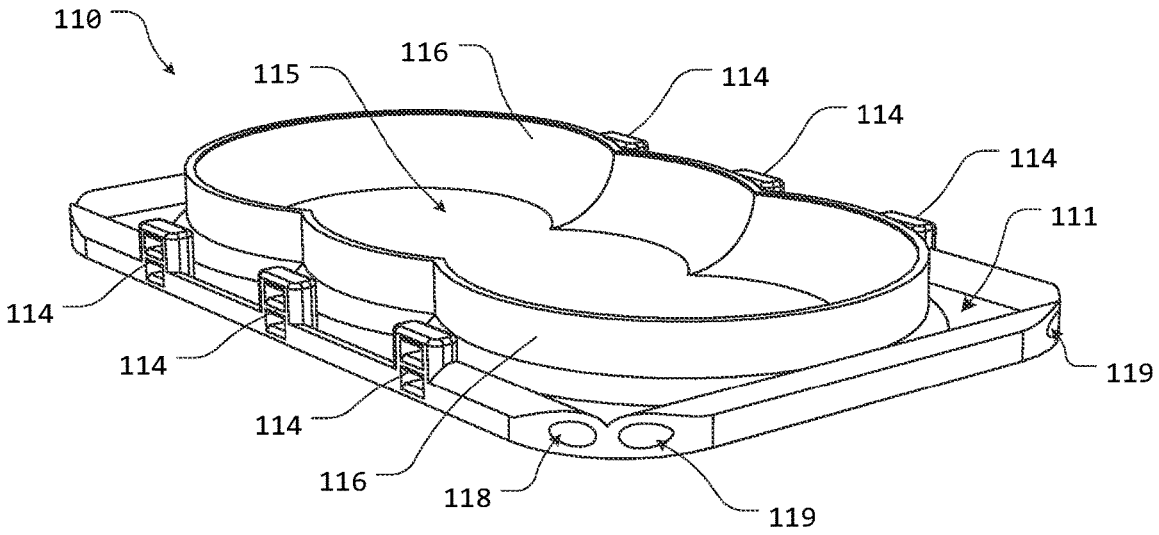
FIG. 4 illustrates an upper, perspective view of an exemplary embodiment of a stabilization plate, according to at least one exemplary, non-limiting embodiment of the present disclosure.
Figure 5:
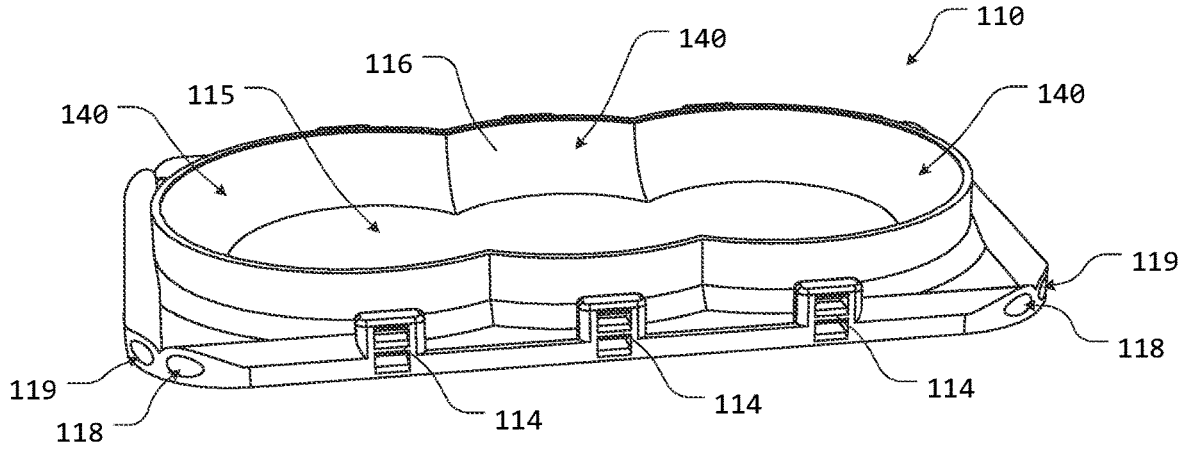
FIG. 5 illustrates an upper, perspective view of an exemplary embodiment of a stabilization plate, according to at least one exemplary, non-limiting embodiment of the present disclosure.
Figure 6:
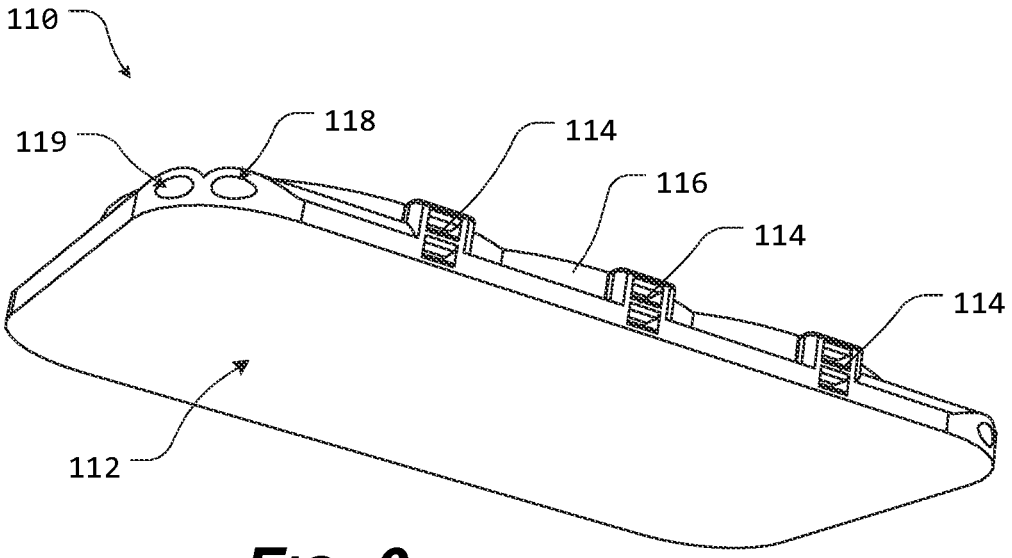
FIG. 6 illustrates a lower, perspective view of an exemplary embodiment of a stabilization plate, according to at least one exemplary, non-limiting embodiment of the present disclosure.
Figure 7:
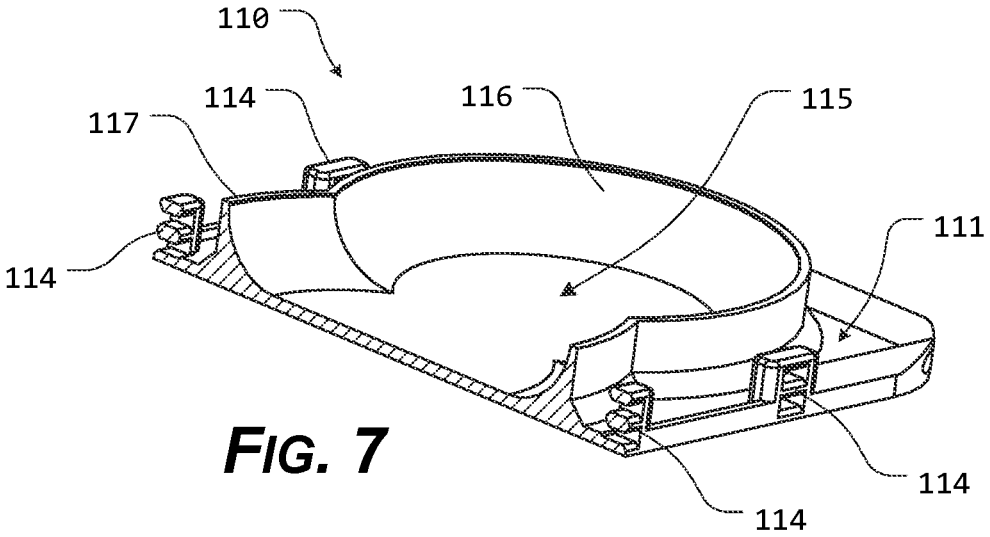
FIG. 7 illustrates an upper perspective, cross-sectional view of an exemplary embodiment of a stabilization plate, according to at least one exemplary, non-limiting embodiment of the present disclosure.
Figure 8:
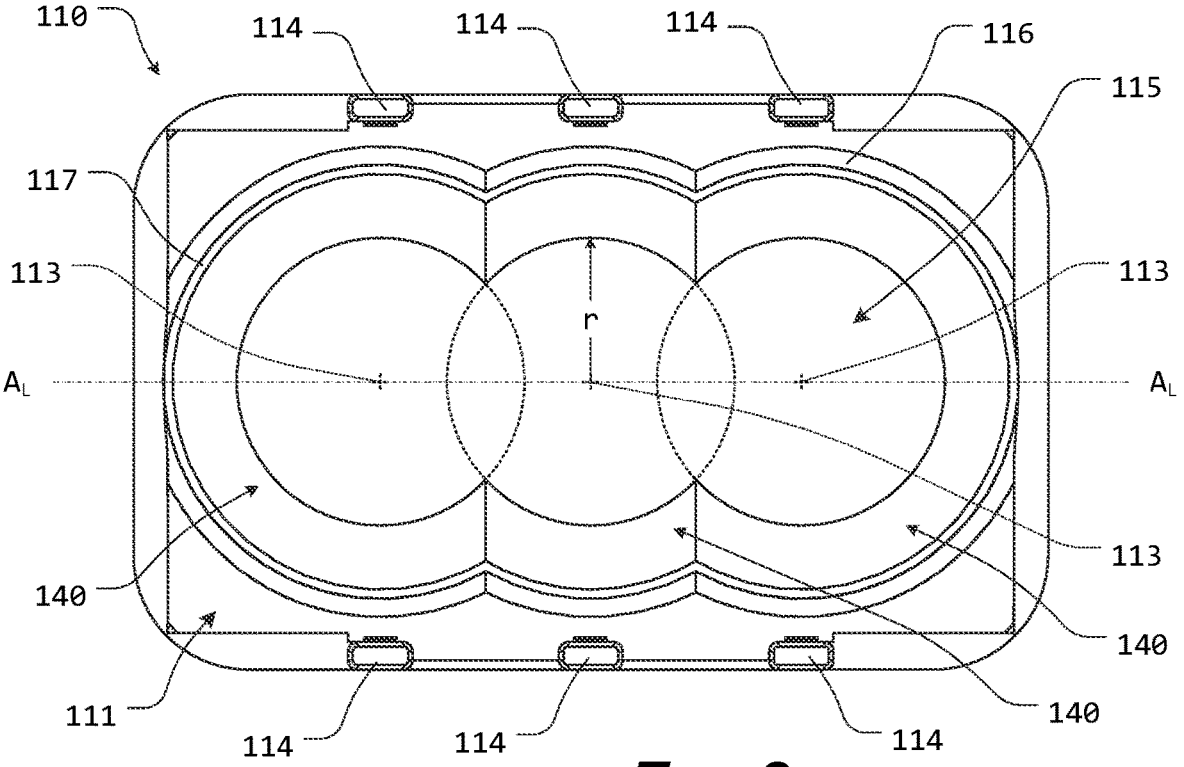
FIG. 8 illustrates a top view of an exemplary embodiment of a stabilization plate, according to at least one exemplary, non-limiting embodiment of the present disclosure.
Figure 9:
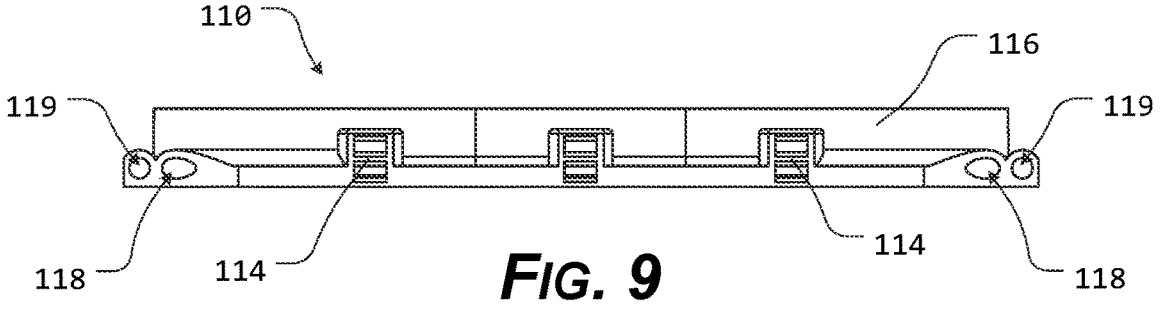
FIG. 9 illustrates a front view of an exemplary embodiment of a stabilization plate, according to at least one exemplary, non-limiting embodiment of the present disclosure.
Figure 10:
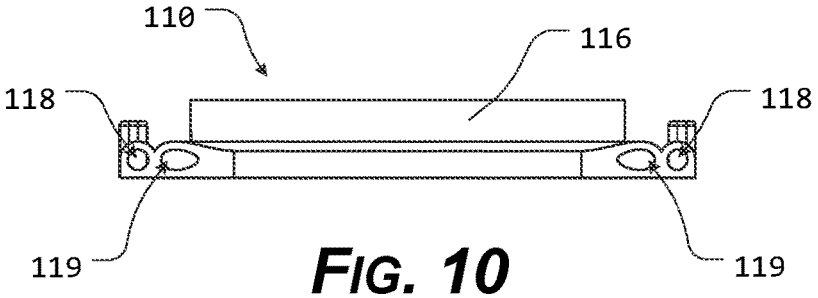
FIG. 10 illustrates a side view of an exemplary embodiment of a stabilization plate, according to at least one exemplary, non-limiting embodiment of the present disclosure.
Figure 11:
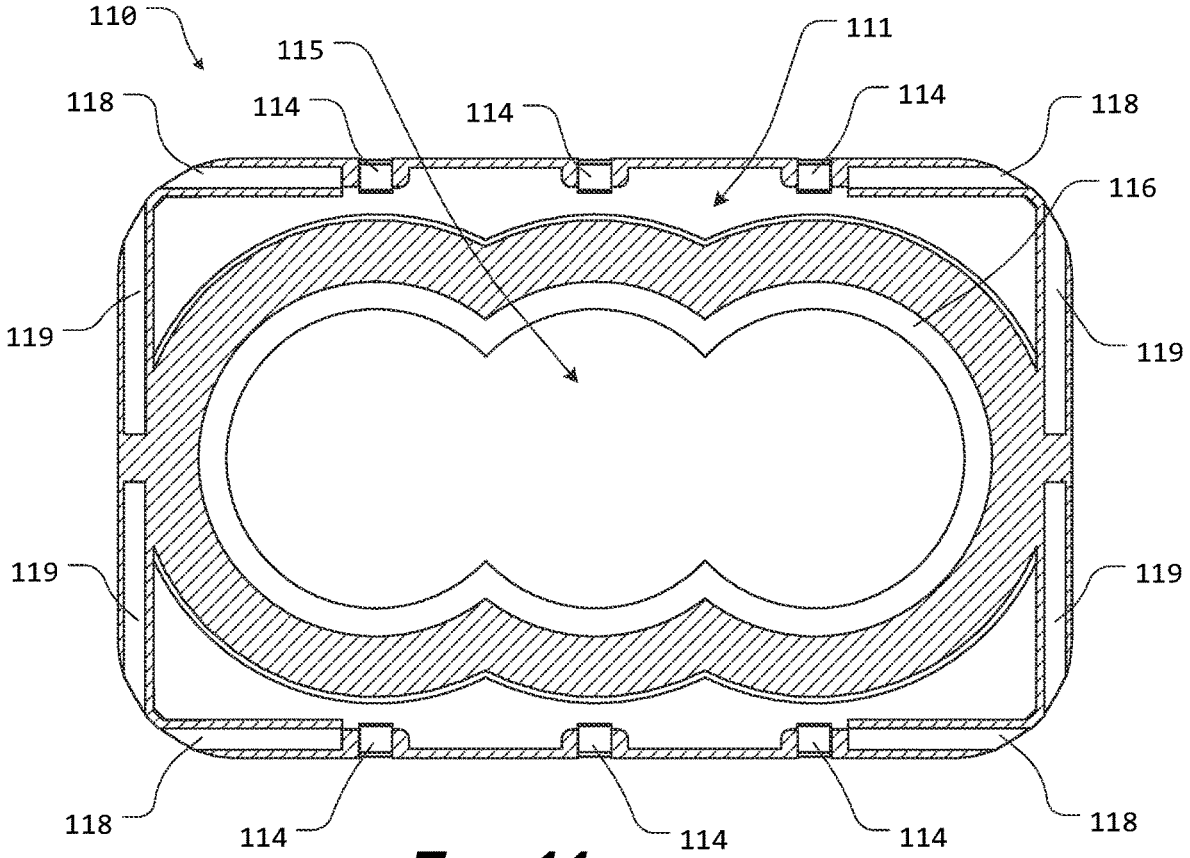
FIG. 11 illustrates a top, cross-sectional view of an exemplary embodiment of a stabilization plate, according to at least one exemplary, non-limiting embodiment of the present disclosure.
Figure 12:
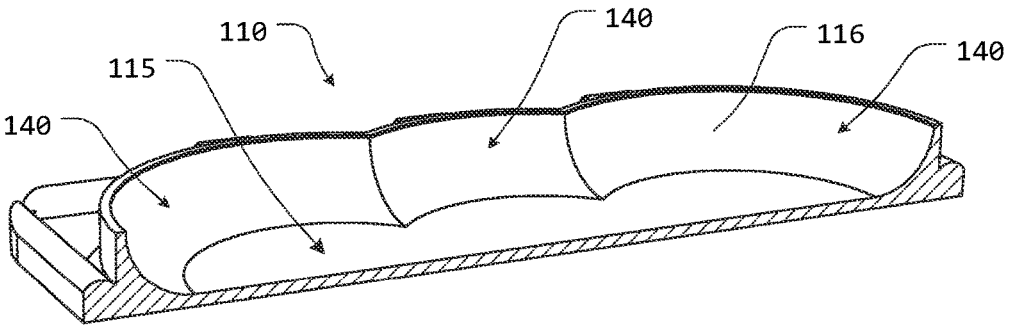
FIG. 12 illustrates a side, cross-sectional view of an exemplary embodiment of a stabilization plate, according to at least one exemplary, non-limiting embodiment of the present disclosure.
Figure 13:
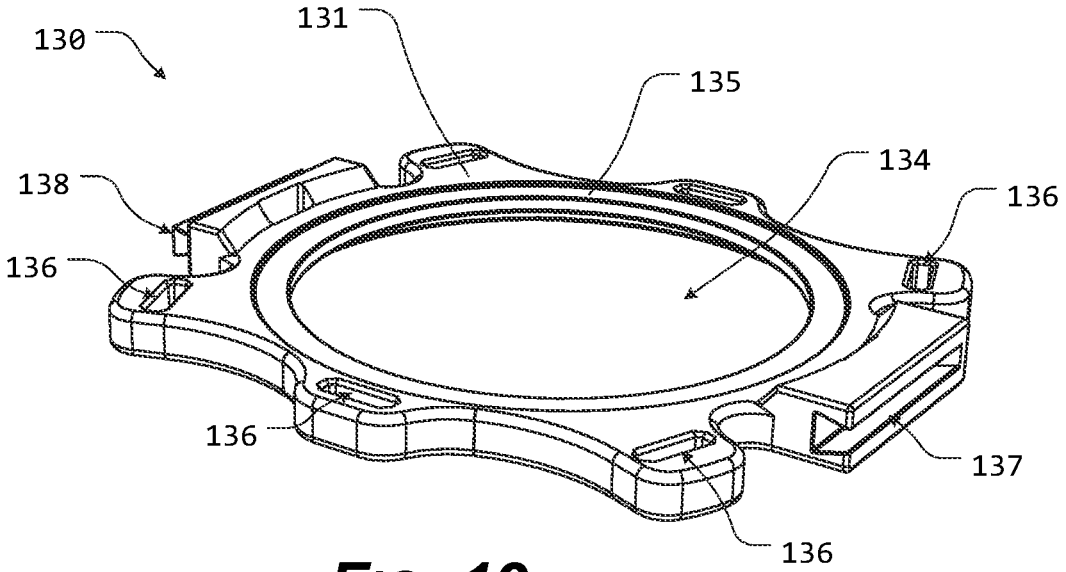
FIG. 13 illustrates an upper, perspective view of an exemplary embodiment of a connector ring, according to at least one exemplary, non-limiting embodiment of the present disclosure.
Figure 14:
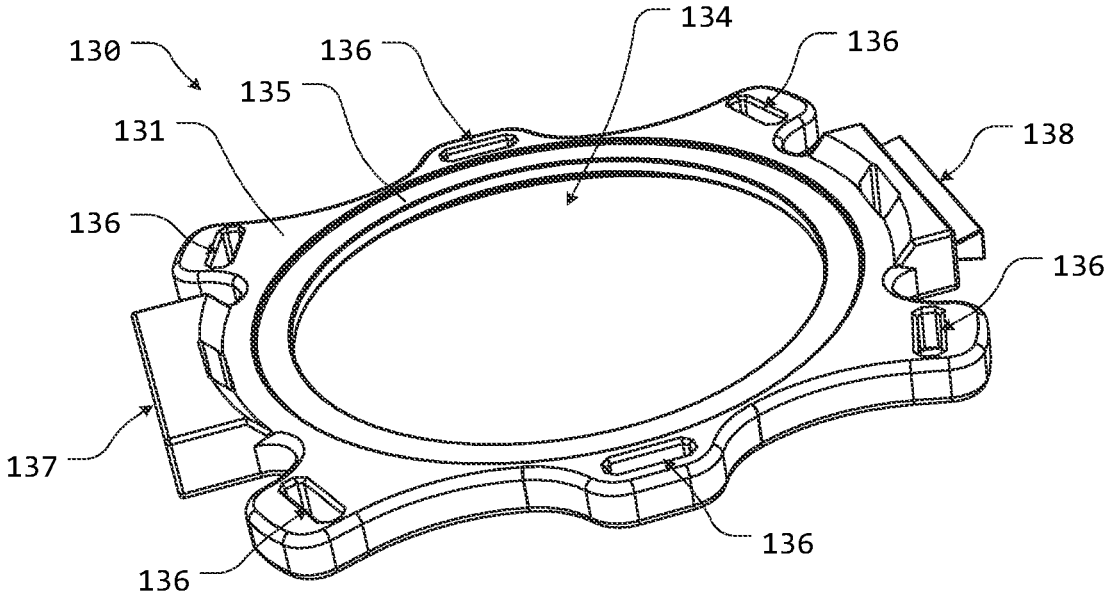
FIG. 14 illustrates an upper, perspective view of an exemplary embodiment of a connector ring, according to at least one exemplary, non-limiting embodiment of the present disclosure.
Figure 15:
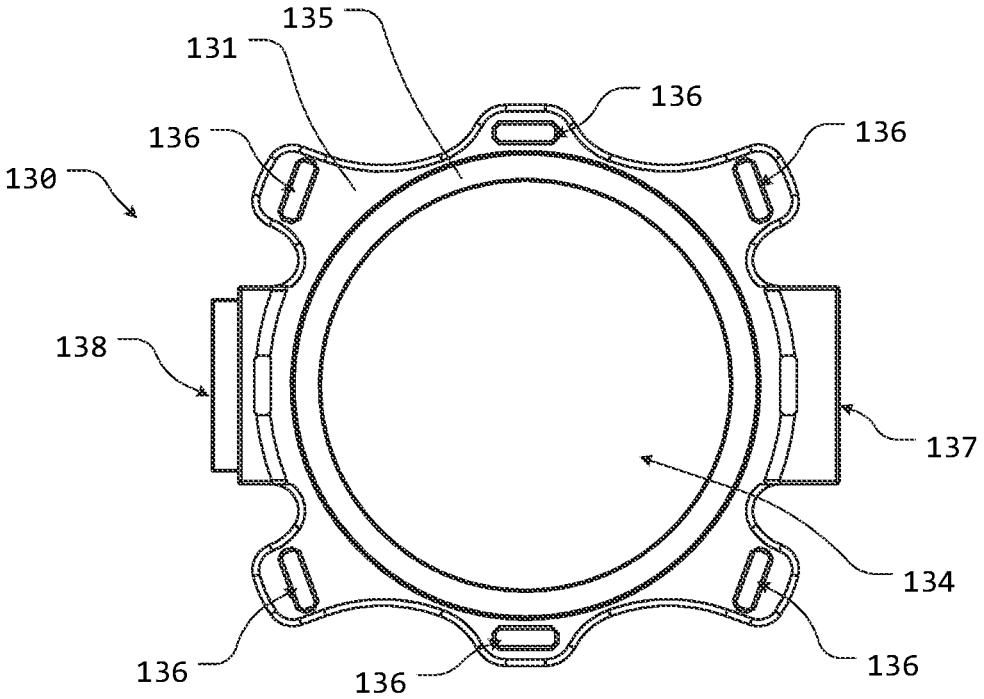
FIG. 15 illustrates a top view of an exemplary embodiment of a connector ring, according to at least one exemplary, non-limiting embodiment of the present disclosure.
Figure 16:
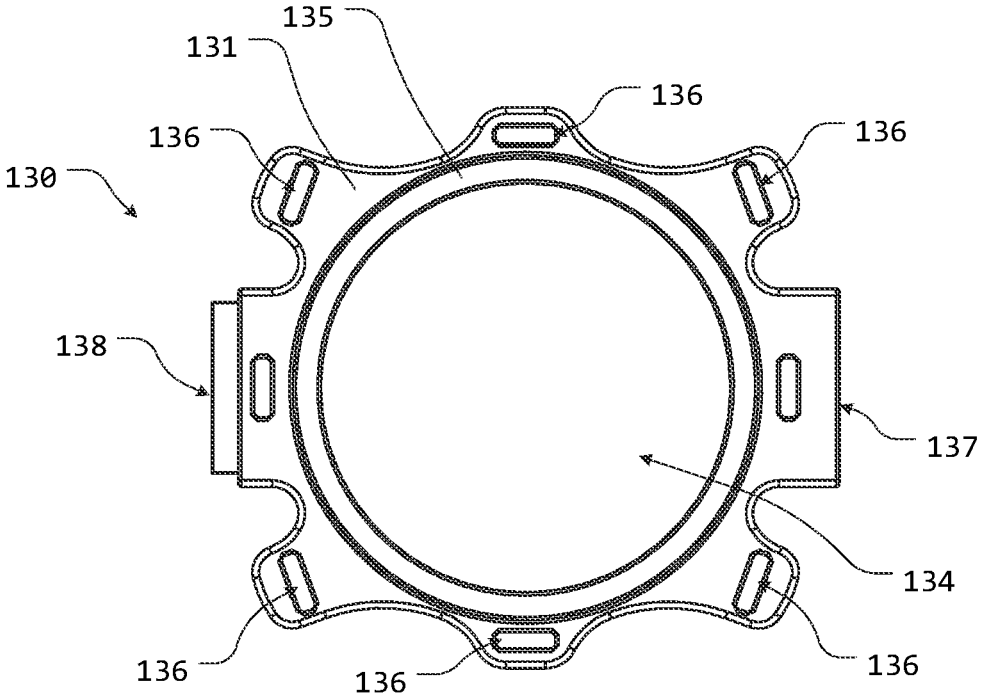
FIG. 16 illustrates a bottom view of an exemplary embodiment of a connector ring, according to at least one exemplary, non-limiting embodiment of the present disclosure.
Figure 17:
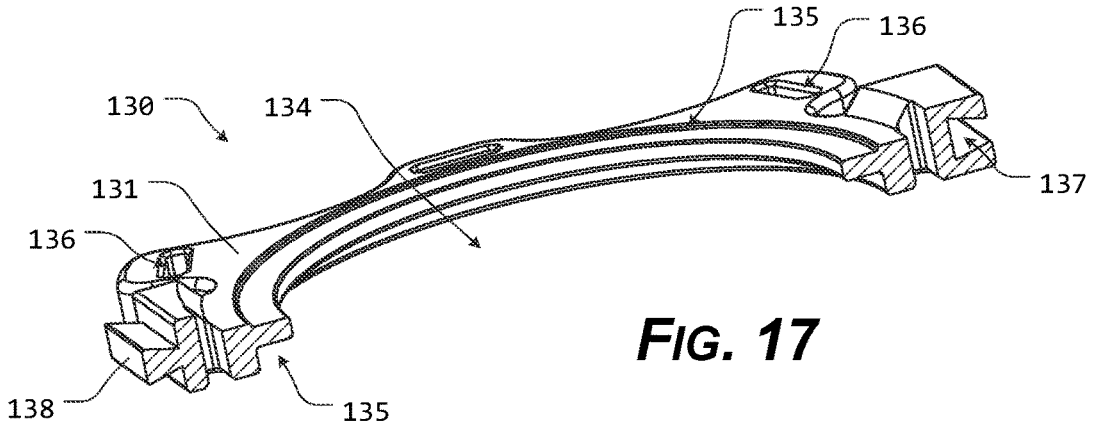
FIG. 17 illustrates a side, cross-sectional, perspective view of an exemplary embodiment of a connector ring, according to at least one exemplary, non-limiting embodiment of the present disclosure.
Figure 18:
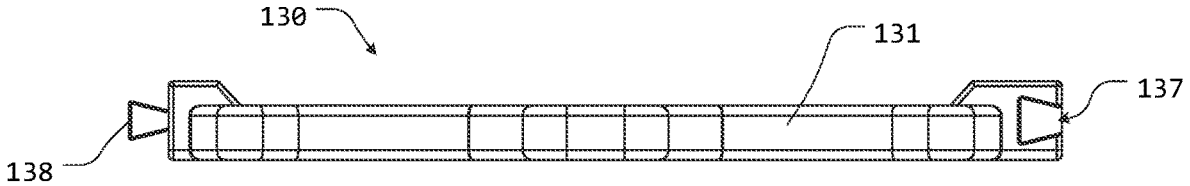
FIG. 18 illustrates a front view of an exemplary embodiment of a connector ring, according to at least one exemplary, non-limiting embodiment of the present disclosure.
Figure 19:
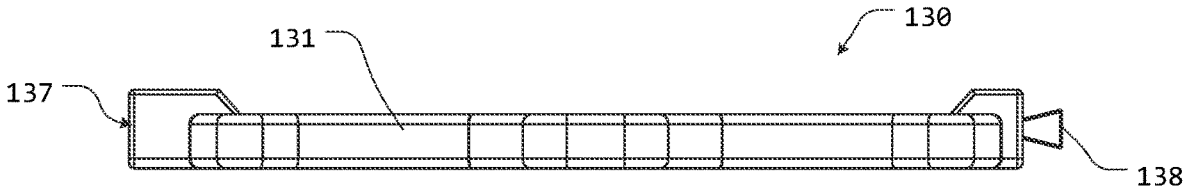
FIG. 19 illustrates a rear view of an exemplary embodiment of a connector ring, according to at least one exemplary, non-limiting embodiment of the present disclosure.
Figure 20:
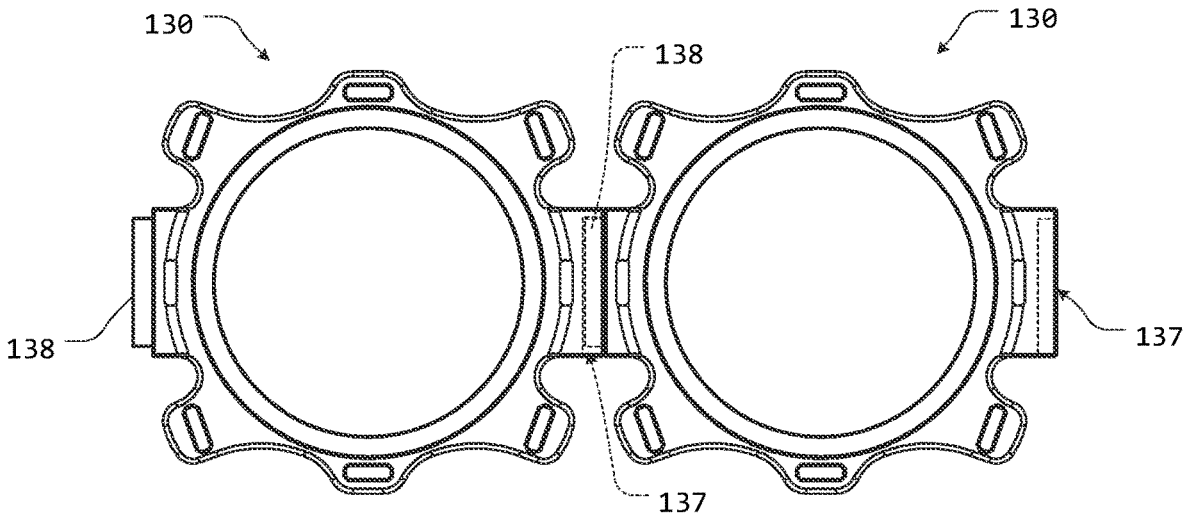
FIG. 20 illustrates a top view of two exemplary embodiments of a connector ring, attached or coupled together, according to at least one exemplary, non-limiting embodiment of the present disclosure.
Figure 21:
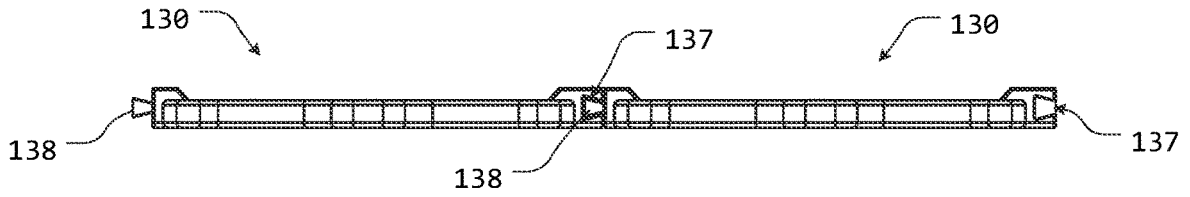
FIG. 21 illustrates a front view of two exemplary embodiments of a connector ring, attached or coupled together, according to at least one exemplary, non-limiting embodiment of the present disclosure.

As illustrated most clearly in FIGS. 1-3, the explosive disruptor 170 comprises at least some of a container 171, a disruptor tube 173, a container cap 175, a strain relief connector 177, and a connector nut 179.

In various exemplary embodiments, the container 171 includes an exterior surface and an interior surface. External container threads are formed in the exterior surface of a portion of the container 171, extending from or within a neck portion 172 of the container 171 towards or to the container open end. The external threading of the external container threads is formed so as to allow interaction between the external container threads and the container cap internal threads, formed within the cap recess of the container cap 175, such that the container cap 175 can be repeatably threadedly attached or removed from the external container threads of the container 171.

In various exemplary embodiments, the explosive disruptor 170, the container 171, the strain relief connector 177, the disruptor tube 173, the container cap 175, and the connector nut 179 are or operate similarly to the container, the strain relief connector, the disruptor tube, the container cap, and the connector nut as disclosed in U.S. Pat. No. 11,493,301, issued Nov. 8, 2022 and/or pending U.S. patent application Ser. No. 17/980,947, filed Nov. 4, 2022, the disclosures of which are incorporated herein in their entireties by reference.

In various exemplary, nonlimiting embodiments, the container 171, may comprise a plastic or other bottle such as, for example, a Nalgene© or other similar bottle. Therefore, it should be appreciated that the size or type of bottle or container used in connection with the stabilization plate 110 may vary.

In various exemplary, nonlimiting embodiments, as illustrated most clearly in FIGS. 4-12, the stabilization plate 110 comprises a rectangular portion of material having a stabilization plate top side 111 and an opposing stabilization plate bottom side 112. Various portions of the stabilization plate top side 111 and/or the stabilization plate bottom side 112 are substantially planar. While the stabilization plate 110 is illustrated as being substantially rectangular, the present disclosure is not so limited. Thus, the stabilization plate 110 may have any desired overall shape, including, for example, square, rectangular, circular, oval, triangular, etc.

In various exemplary embodiments, an optional ridge 116 is formed in or extends from at least a portion of the stabilization plate top side 111. Generally, the ridge 116 provides a perimeter around at least a portion of the stabilization plate top side 111 to define a concave, stabilization plate recess 115 of the stabilization plate top side 111. In various exemplary embodiments, the surface of the stabilization plate 110, defined within the stabilization plate recess 115 is substantially planar. Alternatively, the surface of the stabilization plate 110, defined within stabilization plate recess 115 may matingly correspond to a bottom surface of an exemplary container 171.

In various exemplary embodiments, the ridge 116 comprises a continuous, uninterrupted ridge 116 that defines the stabilization plate recess 115. Alternatively, the ridge 116 comprises two or more ridge segments, which together generally define the stabilization plate recess 115.

As illustrated, the ridge 116 is formed so as to comprise, define, or outline three aligned, interlaced, overlapping or at least partially overlapping circles or overlapping circular recesses 140, when viewed from the top of the stabilization plate 110. The circular recesses 140 are arranged so that the centers 113 of the circular recesses 140 are aligned along the longitudinal axis, $A_L$, of the stabilization plate 110, at spaced apart locations. In various exemplary embodiments, the centers 113 of the circular recesses 140 are equally spaced from one another. The circular recesses 140 are arranged such that each circular recess 140 at least partially overlaps each adjacent circular recess 140.

In certain exemplary embodiments, the centers 113 of the circular recesses 140 are spaced from one another at a distance that is equal to one and one half (1.5×r) the length of the radius, r, of each of the circular recesses 140. In this manner, a single exemplary container 171 may be positioned in any of three optional positions, as defined by the three circular recesses 140, as illustrated, for example, in FIG. 2. Alternatively, two exemplary containers 171 may only be positioned in the two outermost circular recesses 140, as illustrated, for example, in FIG. 3.

In certain exemplary embodiments, the circular recesses 140 are of equal dimensions and a radius, r, of each of the circular recesses 140 is the same. Alternatively, the radius of one or more of the circular recesses 140 may differ from the radius of the remaining one or more circular recesses 140.

By positioning a container 171 atop the stabilization plate top side 111, within a portion of the stabilization plate recess 115, at least a portion of an exterior bottom portion of the container 171 rests atop the stabilization plate top side 111 and at least a portion of an interior portion of the ridge 116 contacts at least a portion of an exterior bottom portion, a portion of an exterior side wall portion, and/or a portion of an exterior transition portion between the exterior bottom portion and the exterior side wall portion of the container 171. In this manner, at least a portion of the container is positioned within the ridge segment 116 so as to resist lateral movement of the container 171 relation to the stabilization plate 110, thus reducing the likelihood that the container 171 will slide or move laterally relative to the stabilization plate 110.

In certain exemplary embodiments, at least an interior portion of the ridge 116, which extends from the surface of the stabilization plate recess 115, to an uppermost apex or top 117 of the ridge 116 is sloped or arced to match or correspond to a portion of the outer surface of the container 171 that would contact the ridge 116 if the container 171 is positioned atop the stabilization plate top side 111, within a portion of the stabilization plate recess 115.

While the stabilization plate 110 is illustrated as defining three circular recesses 140, providing three optional positions for an exemplary container 171, the present disclosure is not so limited. Thus, it should be appreciated that the stabilization plate 110 may define a single circular recess 140 or two or more circular recesses 140.

The stabilization plate 110 optionally includes one or more stabilization plate anchor slots 114 formed within a portion of the stabilization plate 110. In various exemplary embodiments, each stabilization plate anchor slot 114 comprises an aperture formed through a portion of the stabilization plate 110. Alternatively, each stabilization plate anchor slot 114 comprises a raised portion of the stabilization plate 110 having an aperture formed through the raised portion of the stabilization plate 110. The type, number, and placement of the stabilization plate anchor slots 114 is a design choice.

Each stabilization plate anchor slot 114 is formed so as to allow an anchor strap 180 to be attached thereto or positioned therethrough. In various exemplary embodiments, each anchor strap 180 comprises a zip tie and each stabilization plate anchor slot 114 is formed so as to allow a portion of a zip tie to pass therethrough.

In various exemplary embodiments, stabilization rods 150 can optionally be inserted into rod boreholes 118 and 119 of the stabilization plate 110 to enhance the stabilization of the stabilization plate 110, dependent on the terrain features where the stabilization assembly 100 is to be deployed. If included, rod boreholes 118 and 119 may be formed within or extend into portions of the stabilization plate 110, proximate the terminating edge portions of the stabilization plate 110. Each rod borehole 118 and 119 comprises a recess, cavity, or borehole of appropriate size and depth to allow at least a portion of an elongate stabilization rod 150 to be positioned therein so as to extend from the stabilization plate 110.

In various exemplary embodiments, each rod borehole comprises a cylindrical borehole and each stabilization rod 150 comprises an elongate, cylindrical portion of material.

In certain exemplary embodiments, as illustrated, the rod boreholes 118 are formed substantially parallel to the longitudinal axis, $A_L$, of the stabilization plate 110, while the rod boreholes 119 are formed substantially perpendicular to the longitudinal axis, $A_L$, of the stabilization plate 110. In this manner, a respective stabilization rod 150 may be positioned within each respective rod borehole 118 and 119, providing two stabilization rods 150 extending from each corner of the stabilization plate 110.

Alternatively, the rod boreholes 118 and/or 119 may be formed at alternate acute or obtuse angle relative to the longitudinal axis, $A_L$, of the stabilization plate 110.

As illustrated most clearly in FIGS. 13-21, the connector ring(s) 130, if included, each comprise a ring body 131, having a ring aperture 134 formed therethrough. The ring aperture 134 is formed so as to allow at least a portion of a container 171 to be positioned therethrough. In certain exemplary embodiments, a ring aperture recess 135 extends around at least a portion of the ring aperture 134, within the ring body 131.

Typically, the ring aperture 134 is formed so as to allow at least a portion of the neck portion 172 to extend through the ring aperture 134, so as to allow at least a portion of the external container threads to extend beyond the ring aperture 134 or the ring aperture recess 135. The ring aperture 134 is also formed such that the container cap 175 cannot be passed through the ring aperture 134. Thus, as illustrated, for example, in FIGS. 2 and 3, a connector ring 130 may be positioned atop a container 171 such that at least a portion of the external container threads extend beyond the ring aperture 134 and the ring aperture recess 135. The container cap 175 can then be threadedly attached or coupled, via interaction with at least some of the external container threads so as to secure the connector ring 130 to the container 171.

In various exemplary embodiments, at least a portion of the container cap 175 can be positioned within at least a portion of the ring aperture recess 135.

The connector ring 130 also includes one or more connector ring anchor slots 136 formed through the connector ring body 131, at various spaced apart locations. Each connector ring anchor slot 136 is formed so as to allow an anchor strap 180 to be attached thereto or positioned therethrough. In various exemplary embodiments, each anchor strap 180 comprises a zip tie and each connector ring anchor slot 136 is formed so as to allow a portion of a zip tie to pass therethrough.

Thus, if a container 171 is positioned atop the stabilization plate 110 and a connector ring 130 is appropriately positioned relative to a container 171, a portion of an anchor strap 180 may be positioned through a stabilization plate anchor slot 114 and a connector ring anchor slot 136, as illustrated, for example, in FIG. 2. The anchor strap 180 acts to further secure the container 171 to the stabilization plate 110, via the connector ring 130. In various exemplary embodiments, a plurality of anchor straps 180 may be utilized to secure a single connector ring 132 the stabilization plate 110.

In this manner, one or more anchor straps 180 may optionally be attached to both the stabilization plate 110 and a connector ring 130. The anchor straps 180 are tightened to further secure the container(s) 171 firmly between the stabilization plate 110 and the connector ring 130. Additional anchor straps 180 may optionally be attached to the connector rings 130 to provide a carry handle for the stabilization assembly 100 for remote or manual placement.

In various exemplary embodiments, each connector ring 130 includes a connector ring recess 137 and a connector ring projection 138. The connector ring recess 137 is formed so as to matingly correspond to the size and shape of the connector ring projection 138. For example, the connector ring projection 138 may comprise a dovetail projection, while the connector ring recess 137 comprises a 3-sided dovetail recess. This allows the connector ring projection 138 of a connector ring 130 to be slidably, removably positioned within at least a portion of the connector ring recess 137 of a subsequent or adjacent connector ring 130.

The connector ring recess 137 is generally formed in the connector ring 130 at a position that is opposite the position of the connector ring projection 138. Thus, as illustrated, for example, in FIGS. 3, 20, and 21, if a connector ring 130 is attached or coupled to a container 171, adjacent containers 171 can be further maintained in a desired position, relative to one another, via slidable attachment of the adjacent connector rings 130 to one another. This way, adjacent containers 171 can be attached together side by side using the connector rings 130 and corresponding, mating connector ring projections 138 and connector ring recesses 137 of adjacent connector rings 130.

In certain exemplary embodiments, an anchor strap 180 may be positioned through a connector ring anchor slot 136 of each of the adjacent connector rings 130 to further secure the connector rings 130 to one another.

A more detailed explanation of the instructions regarding how to utilize the stabilization and/or deployment system is not provided herein because it is believed that the level of description provided herein is sufficient to enable one of ordinary skill in the art to understand and practice the systems, methods, and apparatuses, as described.

While the present disclosure has been described in conjunction with the exemplary embodiments outlined above, the foregoing description of exemplary embodiments of the present disclosure, as set forth above, are intended to be illustrative, not limiting and the fundamental disclosed systems, methods, and/or apparatuses should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A stabilization and deployment system, comprising:

a stabilization plate having a stabilization plate top side, wherein a ridge is formed in or extends from at least a portion of said stabilization plate top side, wherein, said ridge provides a perimeter around at least a portion of said stabilization plate top side to define a stabilization plate recess of said stabilization plate top side, wherein said stabilization plate recess comprises three aligned, at least partially overlapping circular recesses, wherein said circular recesses are arranged such that each circular recess at least partially overlaps each adjacent circular recess, and wherein at least one connector stabilization plate anchor slot is formed through said stabilization plate, wherein said at least one stabilization plate anchor slot is formed so as to allow an anchor strap to be attached thereto or positioned therethrough;

a plurality of rod boreholes formed to extend into portions of said stabilization plate, wherein each rod borehole allows at least a portion of an elongate stabilization rod to be positioned therein such that the stabilization rod extends from said stabilization plate;

at least one connector ring, wherein each said at least one connector ring comprises a ring body having a ring aperture formed through said ring body, wherein said ring aperture is formed so as to allow at least a portion of a container to extend therethrough such that said connector ring may be positioned atop a portion of a container such that at least a portion of the container extends beyond said ring aperture to allow a container cap to be attached or coupled to the container and secure said connector ring to the container, via the container cap, and wherein at least one connector ring anchor slot is formed through said ring body, wherein said at least one connector ring anchor slot is formed so as to allow an anchor strap to be attached thereto or positioned therethrough; and at least one anchor strap, wherein a portion of said at least one anchor strap may be positioned through said at least one stabilization plate anchor slot and a portion of said at least one anchor strap may be positioned through said at least one connector ring anchor slot to attach or couple said at least one connector ring to said stabilization plate.

2. The stabilization and deployment system of claim 1, wherein said stabilization plate comprises a rectangular portion of material.

3. The stabilization and deployment system of claim 1, wherein the container comprises a plastic bottle.

4. The stabilization and deployment system of claim 1, wherein the container is a container of an explosive disruptor.

5. The stabilization and deployment system of claim 1, wherein said stabilization plate comprises a rectangular portion of material.

6. The stabilization and deployment system of claim 1, wherein at least a portion of said stabilization plate top side is substantially planar.

7. The stabilization and deployment system of claim 1, wherein a surface of said stabilization plate, defined within said stabilization plate recess, is substantially planar.

8. The stabilization and deployment system of claim 1, wherein said ridge comprises a continuous, uninterrupted ridge.

9. The stabilization and deployment system of claim 1, wherein said ridge comprises two or more ridge segments, which together generally define said stabilization plate recess.

10. The stabilization and deployment system of claim 1, wherein said circular recesses are arranged so that relative centers of each of said circular recesses are aligned along a longitudinal axis of said stabilization plate.

11. The stabilization and deployment system of claim 1, wherein said circular recesses are arranged so that relative centers of each of said circular recesses are equally spaced from one another.

12. The stabilization and deployment system of claim 1, wherein said circular recesses are arranged so that relative centers of each of said circular recesses are spaced from one another at a distance that is equal to one and one half times a length of a radius of at least one of said circular recesses.

13. The stabilization and deployment system of claim 1, wherein at least an interior portion of said ridge, which extends from a surface of said stabilization plate recess toward an uppermost apex or top of the ridge is sloped or arced.

14. The stabilization and deployment system of claim 1, wherein the container is positionable atop said stabilization plate top side, within a portion of said stabilization plate recess, such that at least a portion of an interior portion of said ridge contacts at least a portion of an exterior portion of the container, within at least a portion of one of said circular recesses so as to resist lateral movement of the container in relation to said stabilization plate.

15. The stabilization and deployment system of claim 1, wherein at least some of said plurality of rod boreholes are formed substantially parallel to a said longitudinal axis of said stabilization plate and wherein at least some of said plurality of said rod boreholes are formed substantially perpendicular to said longitudinal axis of said stabilization plate.

16. The stabilization and deployment system of claim 1, wherein at least some of said plurality of rod boreholes are formed at acute or obtuse angles relative to a said longitudinal axis of said stabilization plate.

17. The stabilization and deployment system of claim 1, wherein each said connector ring includes a connector ring recess and a connector ring projection, wherein said connector ring recess is formed so as to matingly correspond to said connector ring projection such that adjacent connector rings can be maintained in a desired position, relative to one another, via slidable attachment of corresponding, mating connector ring projections and connector ring recesses of adjacent connector rings.

18. The stabilization and deployment system of claim 1, wherein a connector ring recess is formed in each said at least one connector ring at a position opposite a position of a corresponding connector ring projection.

19. A stabilization and deployment system, comprising:

a stabilization plate having a stabilization plate top side, wherein a ridge is formed in or extends from at least a portion of said stabilization plate top side, wherein, said ridge provides a perimeter around at least a portion of said stabilization plate top side to define a stabilization plate recess of said stabilization plate top side, wherein said stabilization plate recess comprises three aligned, at least partially overlapping circular recesses, wherein said circular recesses are arranged such that each circular recess at least partially overlaps each adjacent circular recess, and wherein a container is positionable atop said stabilization plate top side, within a portion of said stabilization plate recess, such that at least a portion of an interior portion of said ridge may contact at least a portion of an exterior portion of the container, within at least a portion of one of said circular recesses so as to resist lateral movement of the container in relation to said stabilization plate; and a plurality of rod boreholes formed to extend into portions of said stabilization plate, wherein each rod borehole allows at least a portion of an elongate stabilization rod to be positioned therein such that the stabilization rod may extend from said stabilization plate.

20. A stabilization and deployment system, comprising:

a stabilization plate having a stabilization plate top side, wherein a ridge is formed in or extends from at least a portion of said stabilization plate top side, wherein, said ridge provides a perimeter around at least a portion of said stabilization plate top side to define a stabilization plate recess of said stabilization plate top side, wherein said stabilization plate recess comprises three aligned, at least partially overlapping circular recesses, wherein said circular recesses are arranged such that each circular recess at least partially overlaps each adjacent circular recess, and wherein said circular recesses are arranged so that a relative center of each of said circular recesses are spaced from one another at a distance that is equal to one and one half times a length of a radius of at least one of said circular recesses; and a plurality of rod boreholes formed to extend into portions of said stabilization plate, wherein each rod borehole allows at least a portion of an elongate stabilization rod to be positioned therein such that the stabilization rod may extend from said stabilization plate, wherein at least some of said plurality of rod boreholes are formed substantially parallel to a longitudinal axis of said stabilization plate and wherein at least some of said plurality of said rod boreholes are formed substantially perpendicular to said longitudinal axis of said stabilization plate.

* * * * *